US006755643B2

(12) United States Patent
Neufeldt

(10) Patent No.: US 6,755,643 B2
(45) Date of Patent: Jun. 29, 2004

(54) PROPANE VAPORIZER FOR FUEL POWERED DEVICES

(76) Inventor: Allen A. Neufeldt, 85 Nymark Ave., Willowdale, Ontario (CA), M2T 2H2

( * ) Notice: Subject to any disclaimer, the term of this patent is extended or adjusted under 35 U.S.C. 154(b) by 0 days.

(21) Appl. No.: 10/166,754

(22) Filed: Jun. 12, 2002

(65) Prior Publication Data

US 2003/0232298 A1 Dec. 18, 2003

(51) Int. Cl.[7] ..... F23D 11/44
(52) U.S. Cl. ..... 431/247; 431/11
(58) Field of Search ..... 431/247, 248, 431/11, 12

(56) References Cited

U.S. PATENT DOCUMENTS 3,897,194 A * 7/1975 von Wiesenthal ..... 431/11
4,008,041 A * 2/1977 Roffe et al. ..... 392/397
4,255,646 A * 3/1981 Dragoy et al. ..... 392/396
5,054,546 A * 10/1991 Forster ..... 165/110
5,611,366 A * 3/1997 Creffield et al. ..... 137/209

* cited by examiner

*Primary Examiner*—Alfred Basichas
(74) *Attorney, Agent, or Firm*—Daryl W. Schnurr

(57) ABSTRACT

A vaporizer is connected to a liquid propane supply. The vaporizer contains a helical coil immersed in a bath. A pressure regulator at an inlet to the coil reduces the pressure and vaporizes part of the propane. A burner connected to the outlet of the vaporizer is used to heat the bath. Part of the vapor is returned to the supply to pressurize the supply. The main part of the vapor from the outlet is used to power a fuel powered device.

21 Claims, 2 Drawing Sheets

PROPANE VAPORIZER FOR FUEL POWERED DEVICES

BACKGROUND OF THE INVENTION

1. Field of the Invention

This invention relates to a vaporizer to vaporize liquid petroleum gas. More particularly, this invention relates to a vaporizer that is used outdoors to operate fuel powered devices using liquid propane, butane, isobutane and the like.

2. Description of the Prior Art

Vaporizers for liquid propane and other liquid petroleum gases exist. Most vaporizers use pressure vessels. Liquid propane expands as it cools and pressure is reduced. The pressure vessel is usually heated with direct flame to vaporize the propane. Over time, a residue accumulates in the pressure tank. Usually, the pressure vessel has a temperature sensing device to control the temperature of the liquid and a float to prevent liquid from exiting through the outlet of the vaporizer. Pressure vessels are expensive and they can be dangerous to operate.

Propane vaporizers used in motor vehicles for carburetion are quite small. Water from the cooling system of the motor vehicle is used to vaporize the liquid fuel.

SUMMARY OF THE INVENTION

It is an object of the present invention to provide a vaporizer that operates at low pressure. It is a further object of the present invention to provide a vaporizer that vaporizes liquid petroleum gas from a high pressure supply and is suitable for operation on a small scale.

A vaporizer is used with a supply of liquid petroleum gas. The vaporizer has a helical coil with an inlet and an outlet. The inlet of the coil is connected to the supply of liquid petroleum gas and the liquid petroleum gas is substantially vaporized in the coil. The outlet is connected to a fuel powered device and there are control means to control the flow of petroleum gas from the supply through the coil to the fuel powered device. The coil is located within a housing containing a bath and the coil is immersed in the bath with heating means to heat the coil.

Preferably, there is a pressure regulator on the inlet to reduce the pressure of the liquid fuel as it exits the supply before the fuel enters the coil.

DESCRIPTION OF A PREFERRED EMBODIMENT

Figure 1:
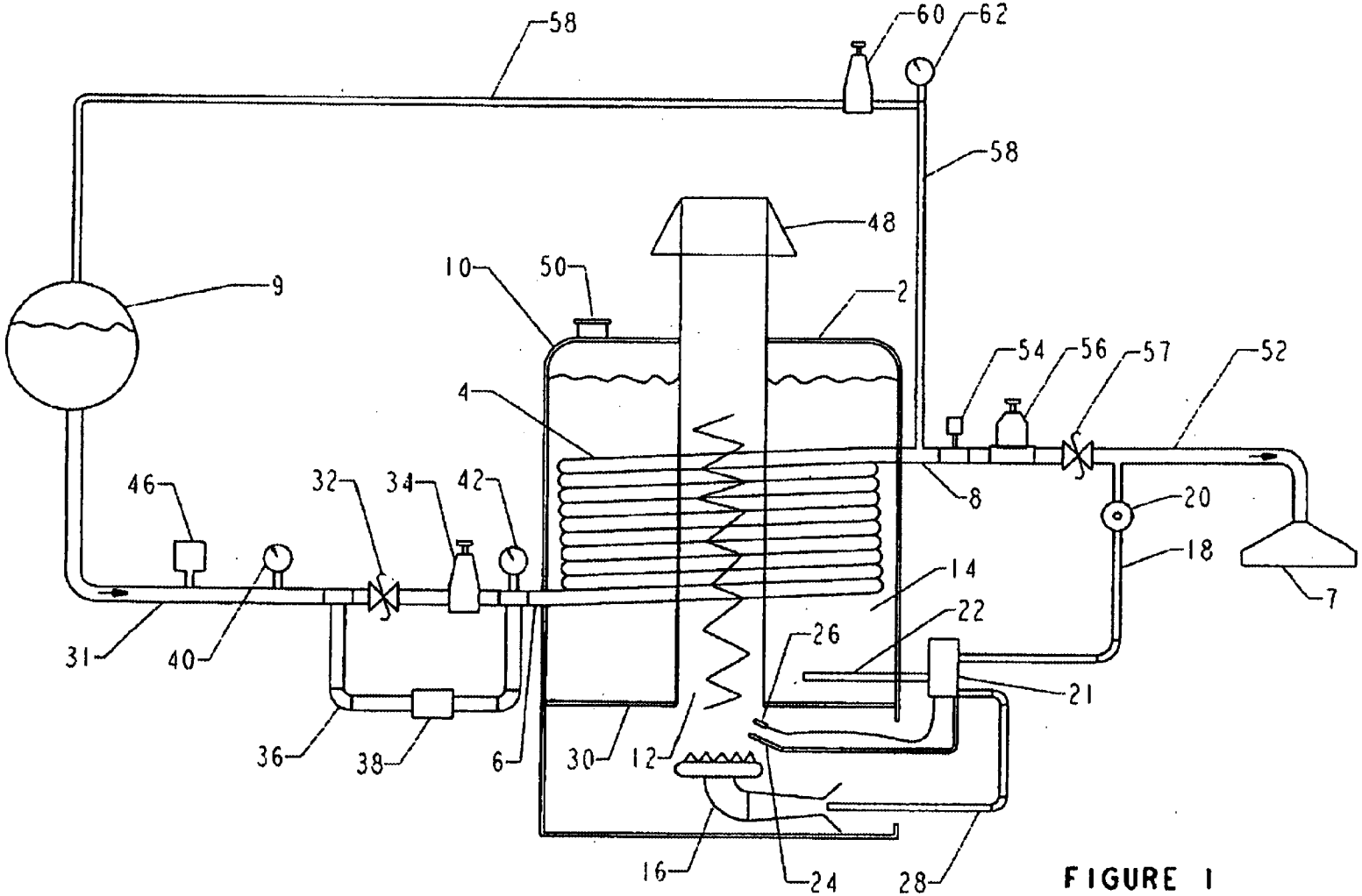
FIG. 1 is a schematic side view of the vaporizer of the present invention.

In FIG. 1, a vaporizer 2 has a coil 4 with an inlet 6 and an outlet 8. The outlet 8 is connected to a fuel powered device 7 and the inlet 6 is connected to a supply of liquid petroleum gas 9. The coil is located within a housing 10, the housing having a centrally located opening or flue 12 extending therethrough. The housing 10 contains a bath 14 and the liquid of the bath is preferably water. There is sufficient water forming the bath 14 to completely immerse the coil 4. A burner 16 is connected to a secondary line 18 extending from the outlet 8. The secondary line 18 has a low pressure regulator 20 to reduce the pressure of vaporized fuel through the secondary line 18 to a temperature controller 21. The controller 21 has a temperature probe 22 extending through a wall of the housing 10 into the bath 14. The temperature controller 21 controls the flow of gas to a pilot light 24 having a thermocouple 26. The temperature controller 21 is connected to a burner line 28, which in turn is connected to the burner 16. The burner is preferably located within the housing 10, but is separated from the bath 14 by a wall 30. The burner 16 is designed to maintain the temperature of the bath 14 within a predetermined range. When the temperature probe indicates that the bath is at the maximum end of the range, the burner automatically shuts off. When the probe indicates that the temperature of the bath is at the minimum end of the range, the burner turns on. That cycle is repeated as required. The fuel supplying the burner is part of the vaporized liquid petroleum gas being produced by the vaporizer. However, the burner could be supplied by a separate fuel supply, separate and apart from the fuel supply of the vaporizer.

An inlet line 31 connected to the inlet 6 has a first solenoid valve 32 and a first pressure regulator 34 connected therein. The first pressure regulator 34 is a liquid pressure regulator. A bypass line 36 extends around the first solenoid valve 32 and first pressure regulator 34. The bypass line 36 contains a check valve 38 to prevent liquid fuel from the supply 9 from flowing around the first solenoid valve 32 and the first pressure regulator 34 and into the coil through the bypass line 36. When the vaporizer is shut off, the liquid flows back into the supply tank through the bypass line 36 and check valve 38. There are two pressure gauges 40, 42 located upstream and downstream, respectively, of the first solenoid valve 32 and the first pressure regulator 34 of the inlet line 31. Upstream from the pressure gauge 40, there is located a hydrostatic relief valve 46.

The opening 12, is a flue and, at the top of the flue, there is located a vent 48. The housing 10 contains a fill opening 50. An outlet line 52 is connected to the outlet 8 and contains a temperature sensor 54, a second pressure regulator 56 and a second solenoid 57. The second pressure regulator 56 is a vapor pressure regulator. A return line 58 extends from the outlet 8 to the liquid fuel supply 9. The return line 58 contains a third regulator 60. The third regulator 60 allows part of the vapor produced by the vaporizer to flow to the vapor portion of the supply tank 9 through the return line 58 in order to maintain sufficient pressure in the supply tank 9. A pressure gauge 62 is located in the return line 58.

Figure 2:
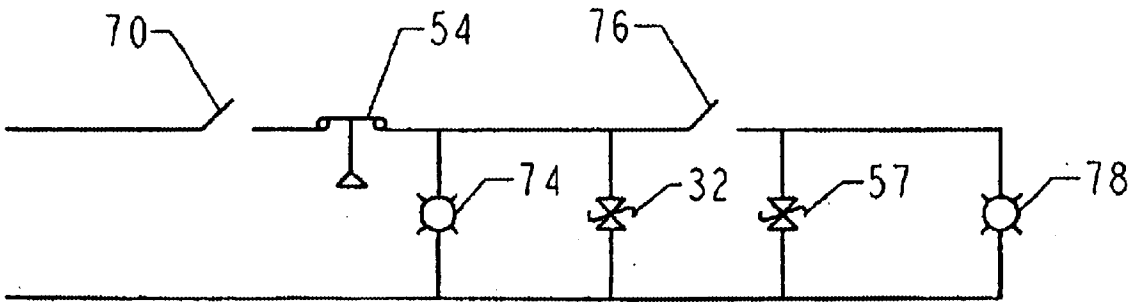
FIG. 2 is a circuit diagram for the vaporizer shown in FIG. 1.

In FIG. 2, there is shown a partial wiring diagram for the vaporizer. It can be seen that the vaporizer has a main switch 70 that can be opened and closed. When the main switch is closed, the vaporizer is turned on and, when the main switch is opened, the vaporizer is turned off. The temperature sensor 54 is normally closed but opens when the temperature falls, thereby shutting down the vaporizer. The temperature sensor 54 will open when the draw on the vaporizer exceeds the capacity of the vaporizer or when the heating system of the water bath fails. The first solenoid valve 32 operates an indicator light 74 when the valve is open. A second solenoid valve 57 is located in the outlet line. The second solenoid valve 57 located in the outlet line operates an indicator light 78 when the valve 57 is open. An outlet switch 76 opens and closes the second solenoid valve 57 of the outlet line.

In operation, the liquid fuel supply 9 has an outlet valve (not shown). The outlet valve of the fuel supply is opened when it is desired to operate the vaporizer. The main switch 70 is closed, thereby opening the first solenoid valve 32. Liquid fuel flows through the first pressure regulator 34, thereby reducing the pressure of the liquid fuel and partially vaporizing the fuel. The enthalpy of the liquid fuel is reduced by the liquid pressure regulator 34. The partially vaporized liquid fuel flows into the coil 4 and ultimately out of the outlet 8 where part of the vaporized fuel is used to power the burner 16. The bath 14 is heated and the heating of the bath in turn heats the coil 4 causing all of the liquid fuel within the coil to vaporize before the fuel reaches the outlet 8. If necessary the third regulator 60 is opened to return part of the vaporized fuel to the vapor portion of the fuel supply to maintain the pressure of the fuel supply 9. The main portion of the vaporized fuel runs through the outlet line 52 to a fuel powered device 7. If the fuel powered device requires more vapor than the vaporizer is able to produce, the temperature of the vapor will decrease and the temperature sensor 54 will cause the first solenoid 32 and the second solenoid 57 to close, thereby shutting down the outlet line 52 and the vaporizer 2. The bypass line 36 allows fuel to flow back to the supply 9 when the vaporizer is shut down, but does not allow liquid fuel to bypass the first solenoid valve 32 and first pressure regulator 34. The second pressure regulator 56 at the outlet controls the pressure of the vapor leaving the vaporizer.

The fuel powered device can be any suitable device that consumes fuel and is used outdoors. For example, propane burning devices include a joint match heater for asphalt, an asphalt patcher, a construction heater, an infrared burner and a grain dryer. Other fuel powered devices will be suitable as well. Liquid petroleum gases include propane, butane, isobutane, ethane and pentane.

I claim:

1. A vaporizer for use with a supply of liquid petroleum gas, said vaporizer comprising a helical coil having an inlet and an outlet, said inlet of said coil being connected to said supply of liquid petroleum gas, with means to reduce the pressure of said liquid petroleum gas before said liquid petroleum gas enters said coil, said liquid petroleum gas being vaporized in said coil, said outlet being connected to a fuel powered device, there being control means to control a flow of petroleum gas from said supply through said coil to said fuel powered device, said coil being located within a housing containing a bath and said coil being immersed in said bath, with heating means to heat said coil.

2. A vaporizer as claimed in claim 1 wherein said heating means is a fuel powered burner connected to an outlet of said coil.

3. A vaporizer as claimed in claim 2 wherein said burner is located to heat said housing, thereby heating said bath and said coil.

4. A vaporizer as claimed in claim 3 wherein said housing has a centrally located opening extending there through, said burner being located beneath said opening.

5. A vaporizer as claimed in claim 1 wherein the means to reduce pressure is a first pressure regulator located on said inlet, said first pressure regulator being mounted to reduce the pressure of said liquid petroleum gas as it passes through said inlet, thereby vaporizing part of said liquid petroleum gas.

6. A vaporizer as claimed in claim 5 wherein there is a second pressure regulator located on said outlet from said coil, said second pressure regulator further reducing the pressure of said fuel.

7. A vaporizer as claimed in claim 1 wherein said bath is water.

8. A vaporizer as claimed in claim 7 wherein said water has antifreeze added thereto when required to prevent the water from freezing.

9. A vaporizer as claimed in claim 1 wherein there is a first solenoid valve located in said inlet, said solenoid valve being mounted to control the flow of liquid fuel into said oil.

10. A vaporizer as claimed in claim 9 wherein there is a second solenoid valve located in said outlet.

11. A vaporizer as claimed in claim 9 wherein there is a bypass line located at said inlet, said bypass line containing a check valve, said bypass line being connected to provide a return bypass around said first solenoid and said first pressure regulator to allow liquid fuel to be returned to said supply when said vaporizer is shut down.

12. A vaporizer as claimed in claim 11 wherein there are pressure gauges on said inlet line before and after said bypass.

13. A vaporizer as claimed in claim 9 wherein there is a temperature sensor at said outlet, said temperature sensor being electrically connected to said first solenoid valve and a second solenoid valve located in said outlet, said sensor closing the first and second solenoid valves and shutting down the vaporizer when the temperature of vapor fuel at said outlet is below a predetermined minimum.

14. A vaporizer as claimed in claim 9 wherein there is a second solenoid valve located in said outlet, said second solenoid valve being connected to control fuel vapor for exiting through said outlet.

15. A vaporizer as claimed in claim 9 wherein there is a return line located at an outlet of said vaporizer, said return line being connected to a vapor portion art of the supply.

16. A vaporizer as claimed in claim 15 wherein there is a third pressure regulator in the return line to allow vapor to flow from said outlet to said vapor portion of said supply when necessary to pressurize said vapor portion.

17. A vaporizer as claimed in claim 1 wherein the liquid petroleum gas is a fuel selected from the group of propane, butane, isobutane, ethane and pentane.

18. A vaporizer as claimed in claim 1 wherein a line from the outlet to the burner contains a low pressure regulator and a temperature control to operate the burner in a manner to maintain the temperature of the bath within a specified range.

19. A vaporizer as claimed in claim 1 wherein the liquid petroleum gas powered device is selected from the group of an infrared burner, a dryer, construction heaters, grain dryers and asphalt heating equipment.

20. A vaporizer as claimed in claim 1 wherein there is a hydrostatic relief valve located in said inlet.

21. A vaporizer as claimed in claim 1 wherein said tank contains a fill opening and a drain.

* * * * *